US007534949B1

(12) United States Patent
Estes

(10) Patent No.: US 7,534,949 B1
(45) Date of Patent: May 19, 2009

(54) ACOUSTIC SCULPTURE

(75) Inventor: James Alan Estes, Fredericksburg, TX (US)

(73) Assignee: Roark Licensing, LLC, Austin, TX (US)

( * ) Notice: Subject to any disclaimer, the term of this patent is extended or adjusted under 35 U.S.C. 154(b) by 0 days.

(21) Appl. No.: 11/752,892

(22) Filed: May 23, 2007

Related U.S. Application Data

(60) Provisional application No. 60/747,977, filed on May 23, 2006.

(51) Int. Cl.
*G10D 13/08* (2006.01)

(52) U.S. Cl. ..... 84/404; 446/416

(58) Field of Classification Search ..... 84/404, 84/402, 403, 405, 95.1; D17/22; 446/418
See application file for complete search history.

(56) References Cited

U.S. PATENT DOCUMENTS

| | | | | | |
|---|---|---|---|---|---|
| 2,536,800 | A * | 1/1951 | Dodd | 84/725 |
| 2,647,430 | A * | 8/1953 | Schilling | 84/405 |
| 2,769,361 | A * | 11/1956 | Kunz | 84/723 |
| 2,820,431 | A * | 1/1958 | Lescher | 116/169 |
| 2,966,089 | A * | 12/1960 | Gercken | 84/405 |
| 3,651,731 | A * | 3/1972 | Congost Horta | 84/95.1 |
| 3,974,731 | A * | 8/1976 | Joslyn | 84/404 |
| 4,159,665 | A * | 7/1979 | Terzian et al. | 84/404 |
| 4,203,344 | A * | 5/1980 | Krosnick | 84/470 R |
| 4,469,003 | A * | 9/1984 | Phelps | 84/404 |
| 4,885,972 | A * | 12/1989 | Chen | 84/403 |
| 5,561,413 | A * | 10/1996 | Ashibe et al. | 340/393.1 |
| 6,111,178 | A * | 8/2000 | Kile et al. | 84/403 |
| 6,342,662 | B1 * | 1/2002 | Chang | 84/402 |

* cited by examiner

*Primary Examiner*—Lincoln Donovan
*Assistant Examiner*—Jianchun Qin
(74) *Attorney, Agent, or Firm*—Daniel N. Lundeen; Lundeen & Lundeen, PLLC

(57) ABSTRACT

An acoustic sculpture 10 having a main frame structure 12 including an upper support member 14 and a lower support member 16, and a plurality of tube assemblies 24 of varied mass. A tube assembly 24 includes a vertical chime tube 20 acoustically suspended from a coaxial mounting rod 28 mounted to a tube frame. The tube frame can include transverse straps (30, 32) mounted to vertical stiles (34, 34') which are attached to the upper and lower members (14, 16). A striker assembly (48, 48') is attached to the tube frame, for example, the stile portion (34,34'; 34'',34'''), and includes a housing (60, 60') and an actuator button (50, 50'), accessible through a first aperture (64, 64'), operatively connected to transmit motion to a hammer head (54, 54') to strike a chime tube (20, 20') through a second aperture (65, 65') in the back plate (63, 63').

10 Claims, 9 Drawing Sheets

ACOUSTIC SCULPTURE

BACKGROUND OF THE INVENTION

This invention relates to a musical instrument, more particularly to an outdoor, damage-resistant chime-type acoustic sculpture.

SUMMARY OF THE INVENTION

The present invention provides a musical instrument of the chime or percussive type. The musical instrument provides a variety of notes in a desired scale so that even an amateur can make pleasing sounds. The instrument is constructed so as to be weather resistant for outdoor use, and also resists damage or vandalism, e.g. by children in a park or amusement setting. The instrument also facilitates design aesthetics for a pleasing appearance.

In one embodiment, the present invention provides an acoustic sculpture having a main frame structure including upper and lower support members, and a plurality of tube assemblies of varied mass. The tube assemblies have a vertical chime tube acoustically suspended from an upright mounting rod, a tube frame supporting the mounting rod and mounted to the frame structure at the upper and lower members, and a striker assembly. The striker assembly is mounted on the tube frame and includes a housing and an actuator, accessible through a first aperture in the housing, that is operatively connected to transmit motion to a hammer having a head to strike the chime tube through a second aperture in the housing.

The upper and lower members can diverge from one end where the members are joined together to an opposite end where the members are spaced and connected to an upright support post. Preferably, the tube frame comprises spaced stiles spanning the upper and lower members of the main frame, and opposing transverse straps spanning the stiles at respective upper and lower ends thereof. The upright mounting rod can by connected to the opposing transverse straps. The tube frame can include a pair of spaced stiles that span between the upper and lower support members of the main frame, and a pair of opposing transverse straps that span between the pair of spaced stiles at an upper and a lower ends thereof.

In another embodiment, the plurality of tube assemblies can include a cable extending through a first transverse bore in the coaxial mounting rod and a first end of the cable attached to a first section of the vertical chime tube and a second end of the cable attached to an opposing second section of the vertical chime tube to acoustically suspend the vertical chime tube from the coaxial mounting rod. The tube assemblies can include a second cable extending through a second transverse bore in the coaxial mounting rod and a first end of the second cable attached to a third section of the vertical chime tube and a second end of the second cable attached to an opposing fourth section of the vertical chime tube to acoustically suspend the vertical chime tube from the coaxial mounting rod, wherein the second transverse bore is offset from the first transverse bore. The first, second, third and/or fourth sections of a vertical chime tube can be a node.

In yet another embodiment, the striker assembly can include a lower bottom-weighted axle block pivotable about a first transverse axle of the housing having the actuator button mounted thereon and accessible through the first aperture in the housing, and an upper eccentrically-weighted axle block pivotable about a second transverse axle of the housing and connected by a tether to the lower axle block, a first end of a leaf spring arm attached to the upper eccentrically-weighted axle block and a second end of the leaf spring arm attached the hammer head, the hammer head striking the chime tube when the actuator button is displaced.

In another embodiment, the striker assembly can include a lever pivotable about a first transverse axle of the housing. The actuator button can be disposed on a first end of the lever. An opposing second end of the lever can be connected by a tether to an arm of the hammer having the hammer head on an opposing end of the arm pivotable about a second transverse axle in the housing to strike the chime tube when the actuator button is displaced. The tether can be connected to a curved member on a distal portion of the arm to pivot the hammer head towards the second aperture when force is applied to the tether by the lever. The lever can include first and second sections, each extending from the first transverse axle at an acute angle.

DESCRIPTION OF THE INVENTION

Figure 1:
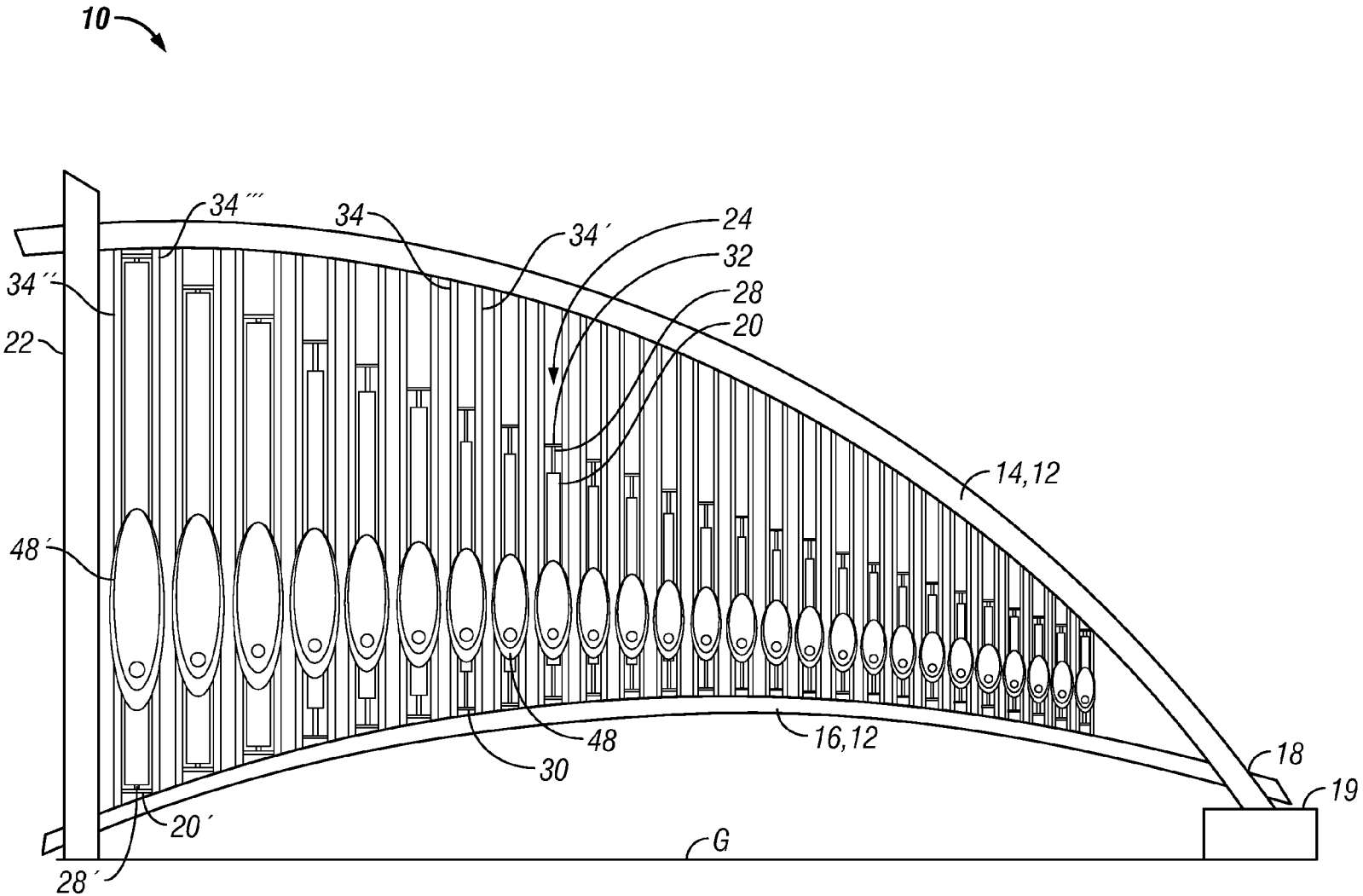
FIG. 1 is a side perspective and top schematic view of an acoustic sculpture, according to one embodiment of the invention.

Referring to FIG. 1, an acoustic sculpture 10 is shown according to one embodiment of the invention. The acoustic sculpture 10 includes a main frame structure 12, preferably steel, which includes an upper support member 14 and a lower support member 16. The upper support member 14 and lower support member 16 diverge from one end where the members are closely spaced or joined together, e.g. by welding at convergence 18. The main frame structure 12 is supported near the convergence 18 of the upper and lower support members (14, 16). For example, upper member 14 can connect to or extend into (as shown) a footing 19, which can be semi-permanently or permanently moored at grade G or other support surface or structure. Although not shown, lower support member 16 can additionally or alternatively connect to or extend into footing 19. At the end opposite the convergence 18, the divergent upper and lower support members (14, 16) are each connected to an upright support post 22, by any means known in the art. Upright support post 22 can be semi-permanently or permanently moored at grade G.

A plurality of tube assemblies 24 are disposed between the upper support member 14 and lower support member 16 of the main frame structure 12. Each tube assembly 24 includes a vertical chime tube 20 supported on a coaxial, upright mounting rod 28 extending from a lower transverse strap 30 to an upper transverse strap 32. The transverse straps (30, 32) connect between opposing stiles (34, 34') to span the space therebetween. Each end of the stile (34, 34') is secured, for example, by welding or bolting, to the upper member 14 and lower member 16. Although a tube frame is shown consisting of transverse straps (30, 32) connected between opposing stiles (34, 34'), a tube frame of any kind and/or configuration can be utilized to connect the mounting rod 28 to the main frame structure 12. A tube frame can utilize a common stile (34, 34') to mount the transverse straps (30, 32), and thus three stiles can be used to mount two chime tubes 20 instead of requiring four stiles to mount two chime tubes 20 as shown in FIG. 1. Coaxial mounting rods 28 of differing diameters can be used, as shown in the table of FIG. 2.

The vertical chime tubes (20, 20') can be made of a weather-resistant material, capable of producing resonant sound upon impact, preferably heavy-walled aluminum of a uniform wall thickness and diameter, such as those made by extrusion or drawing. These chime tubes (20, 20') are commercially available under the trade designation MUSIC OF THE SPHERES®. The chime tubes (20, 20') can be of varying height and/or diameter with a mass corresponding to a range of precision-tuned musical notes in a desired scale, as further discussed below in reference to FIG. 4.

Figure 2:
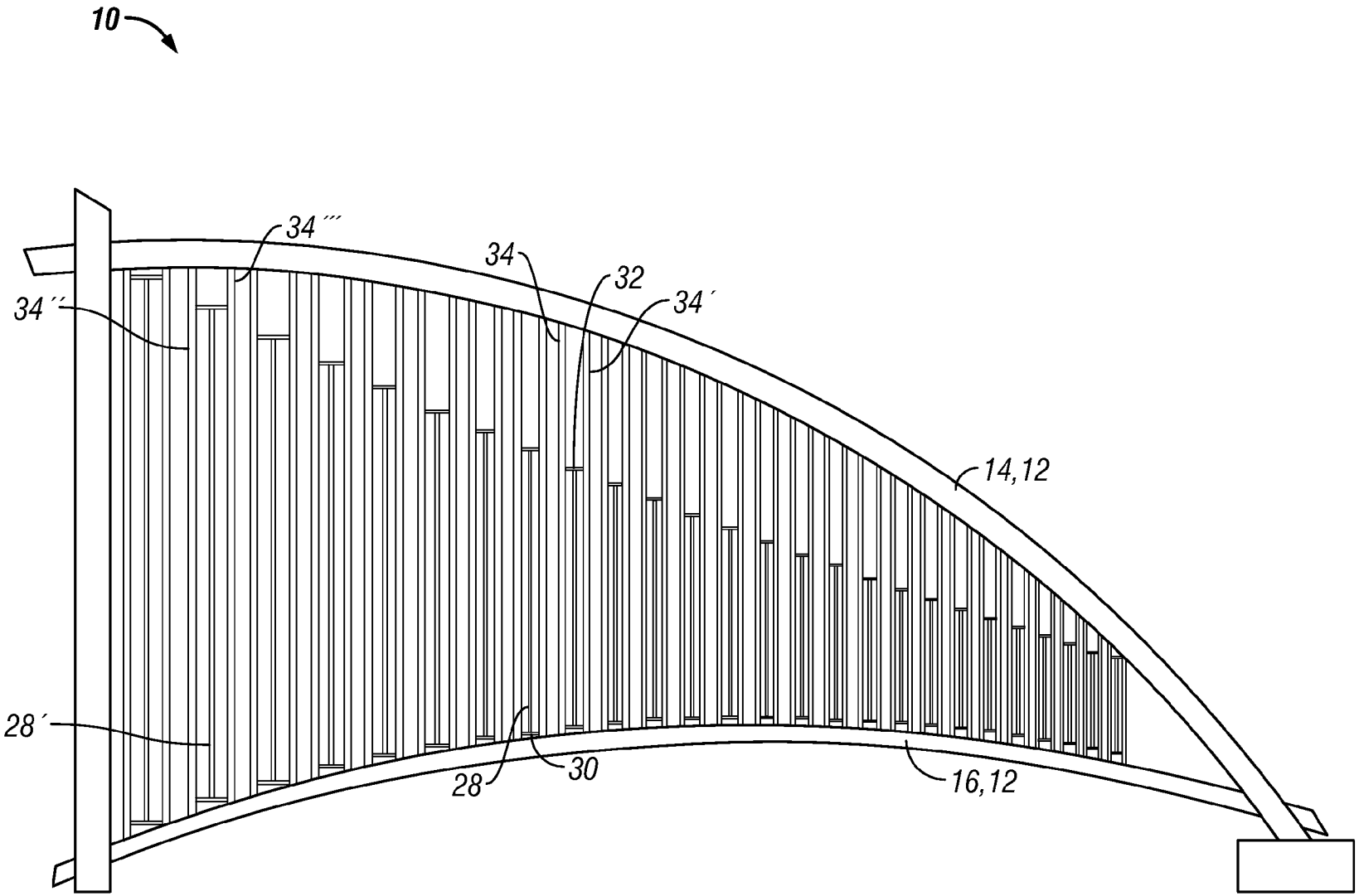
FIG. 2 is a side perspective view of the main frame structure, chime tube mounting rods, and tube frames of FIG. 1; and a top schematic view of a plurality of chime tubes of the acoustic sculpture of FIG. 1 as mounted.

The side perspective view of FIG. 2 shows the acoustical sculpture 10 of FIG. 1 without the striker assemblies or chime tubes installed. Representative dimensions and spacings of one embodiment of the main frame structure 12, which includes an upper support member 14 and a lower support member 16, the chime tube coaxial mounting rods 28, and the stiles (34, 34') and transverse straps (30, 32) which form the tube frames, are also provided. FIG. 2 further includes a table with representative chime tube and mounting particulars.

Figure 3:
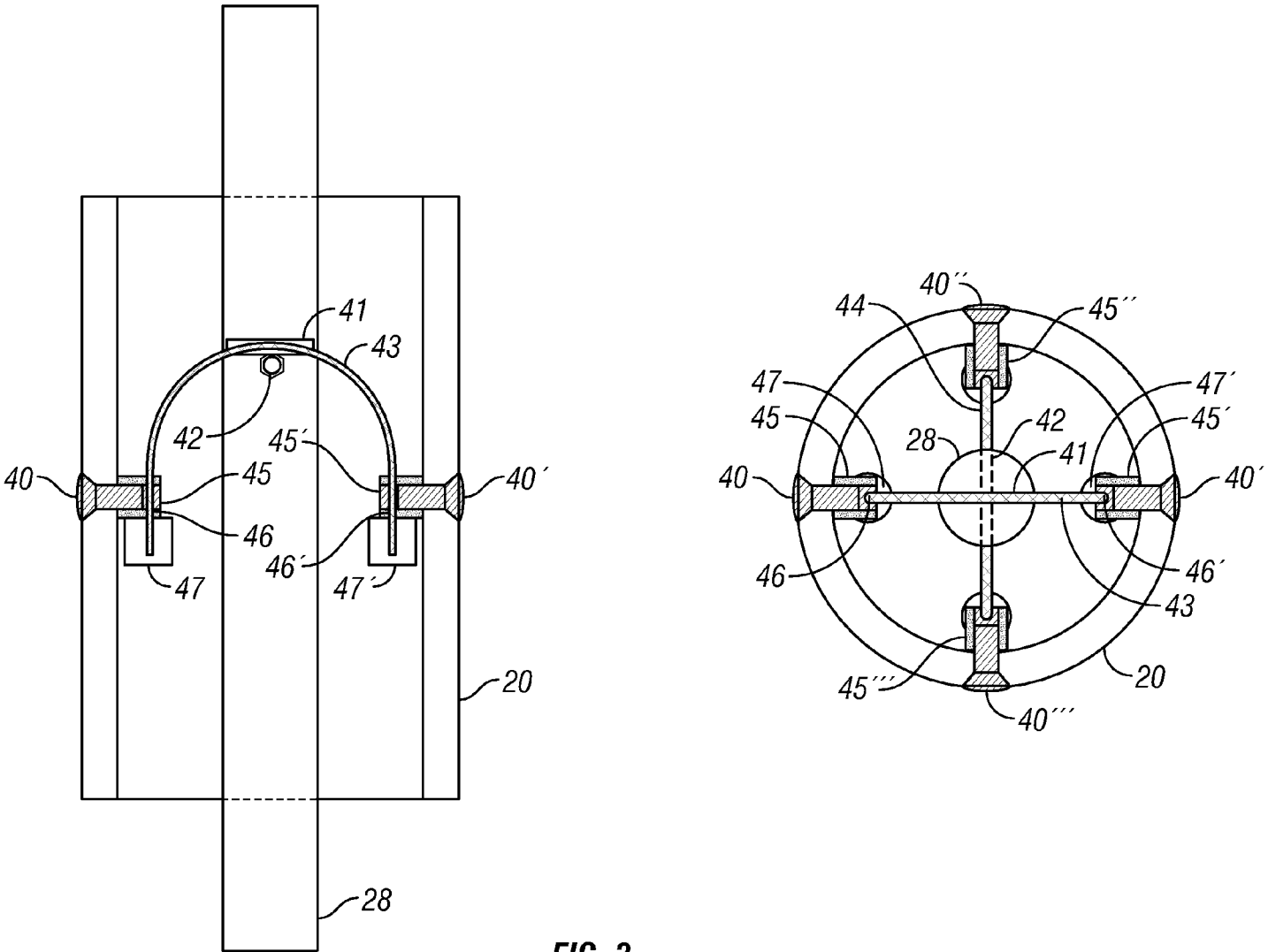
FIG. 3 is a side and top cross-sectional view of typical chime tube acoustically suspended from a coaxial mounting rod of the acoustic sculpture of FIGS. 1 and 2.

Referring now to FIG. 3, a mounting system for acoustically suspending a chime tube 20 from a coaxial mounting rod 28 is illustrated. The mounting system is created by two preferably tamper resistant stainless steel screws (40, 40'), inserted through diametrically opposing apertures on the exterior of the chime tube 20, preferably at a node of minimum vibration and/or in the upper portion of a chime tube 20. Similarly, a cable 43 can mount directly to the wall of a chime tube 20 without forming apertures in the chime tube 20, as is well known in the art. A screw (40, 40') is fastened to a chime mount nut (45, 45') having a transverse passageway (46, 46') for passage of a weather-resistant cable 43. A cable stop (47, 47') is compressed or otherwise attached onto each end of the cable 43 and rests securely beneath the chime mount nut (45, 45'). Preferably, union of each cable stop (47, 47') and the cable 43 is sufficient to substantially support the weight of a vertical chime tube 20. Cable 43 is disposed through a transverse bore 41 in the mounting rod 28. One skilled in the art will readily appreciate that the cable stop (47, 47') on at least one end of the cable 43 can be attached after the cable 43 is threaded through the transverse bore 41 and/or transverse passageways (46, 46') of the chime mount nut (45, 45'). Further, bore 41 can be sized to allow the passage of chime mount nut (45, 45') and cable stop (47, 47') therethrough to simplify the assembly process.

If desired, a second mounting system can be utilized with the chime tube 20 composed of two additional screws (40", 40'"), two additional chime mount nuts (45", 45'") with transverse passageways, and a second wire cable 44 with two additional cable stops (47", 47'"). The second wire cable 44 is installed through a second transverse bore 42 in the coaxial mounting rod 28 that is preferably offset by ninety degrees and located slightly above or below the first bore 41 of the mounting rod 28. By providing two cables (43, 44) the chime tube 20 can be acoustically suspended and coaxially self-centering with respect to the mounting rod 28. Two cables (43, 44) can also provide further support for the weight of the chime tube 20. If two or more cables (43, 44) are used, the length of each cable (43, 44) can be adjusted to provide the desired amount of support.

Figure 4:
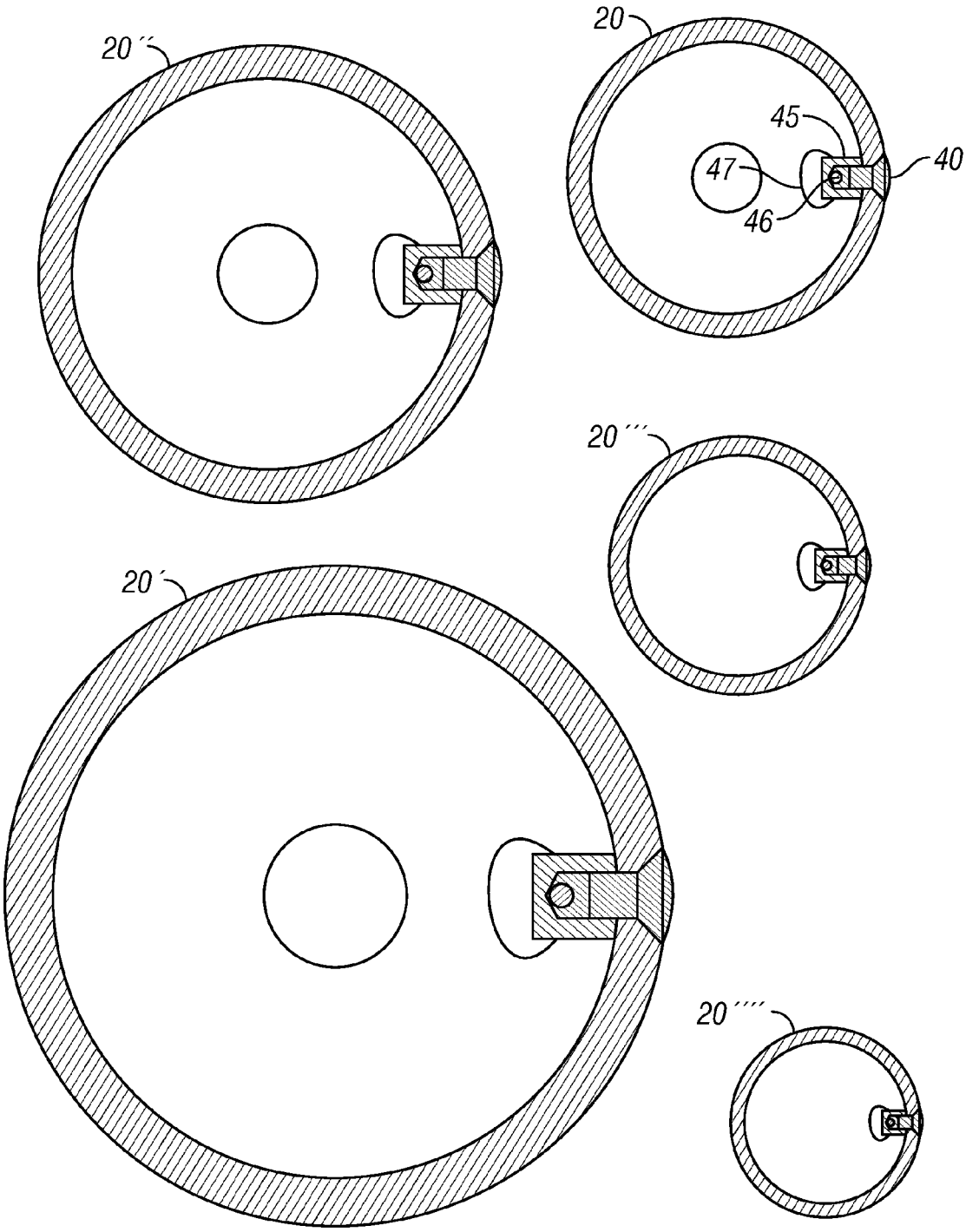
FIG. 4 is a cross-sectional view of a plurality of different sized chime tubes and respective cable mount screws and nuts of the acoustic sculpture of FIGS. 1-3.

FIG. 4 provides representative dimensions for five various masses of chime tube (20-20"") and their corresponding screws, chime mount nuts and cable stops, for use in the mounting system of FIG. 3. For example, the 2½" outer diameter chime tube 20 illustrates one screw 40, one chime mount nut 45 having a transverse passageway 46, and one cable stop 47. Cable stop 47 is not required to adhere to the chime mount nut 45. Although each chime tube (20-20"") is illustrated as a single screw, chime mount nut, and cable stop assembly, a plurality of assemblies can be used without departing from the spirit of the invention.

In a preferred embodiment, chime tube 20 has a 2½" outer diameter and can produce notes generally corresponding to the vocal bass range. Chime tube 20' has a 5¹⁄₁₆" outer diameter and can produce notes generally corresponding to the vocal basso profundo range. Chime tube 20" has a 3½" outer diameter and can produce notes generally corresponding to the vocal contrabass range. Chime tube 20'" has a 2" outer diameter and can produce notes generally corresponding to the vocal tenor range. Chime tube 20"" has a 1½" outer diameter and can produce notes generally corresponding to the vocal soprano-alto range. The five different diameters of chime tubes shown are used for illustration. Any chime tube can be used without departing from the spirit of the invention. The cross-sectional dimensions of the chime tubes (20-20"") are given for exemplary purposes, and the invention is not so limited.

Figure 5A:
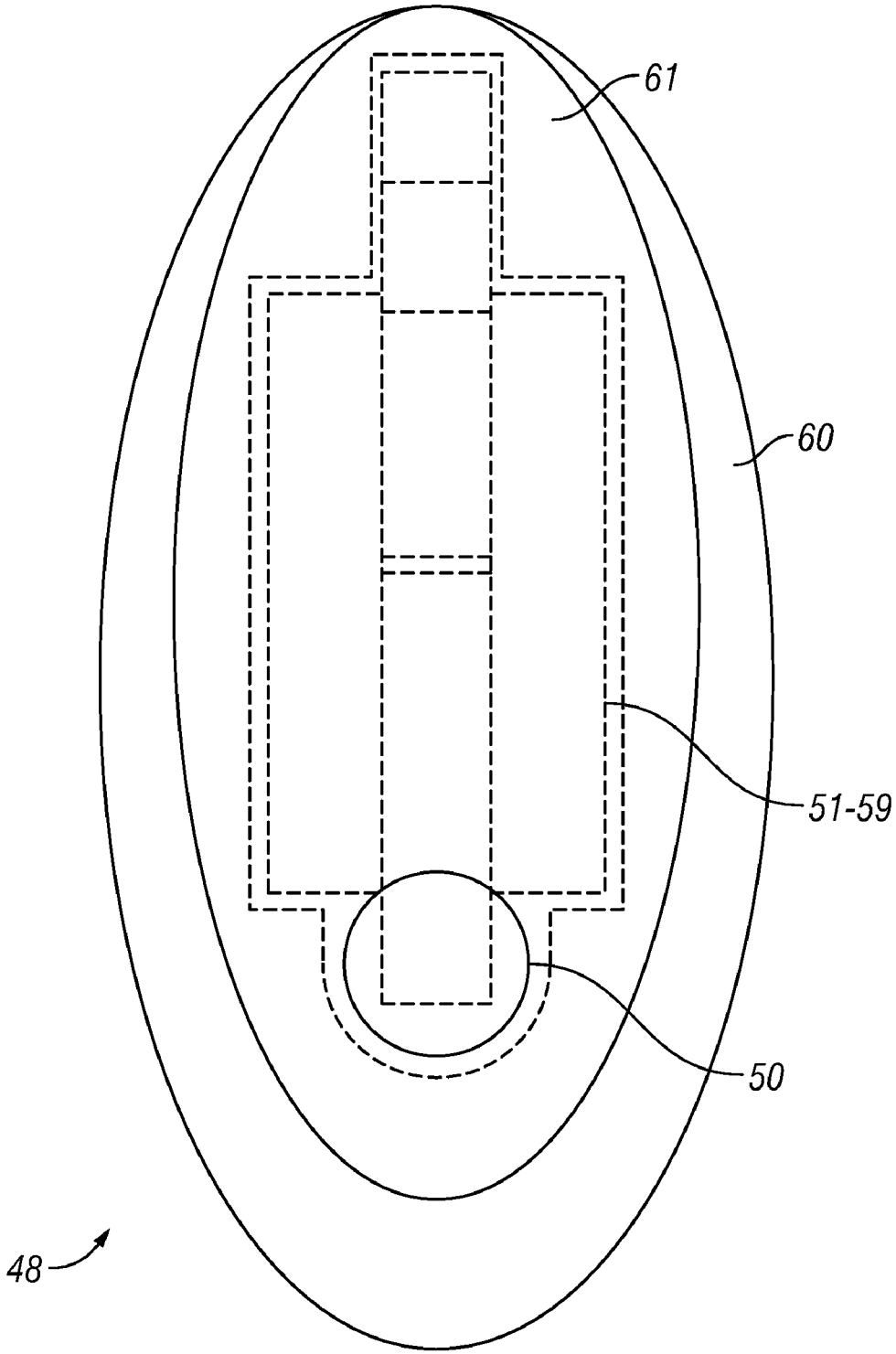
FIG. 5A is a front perspective view of one embodiment of a striker assembly of the acoustic sculpture of FIGS. 1-4.
Figure 5B:
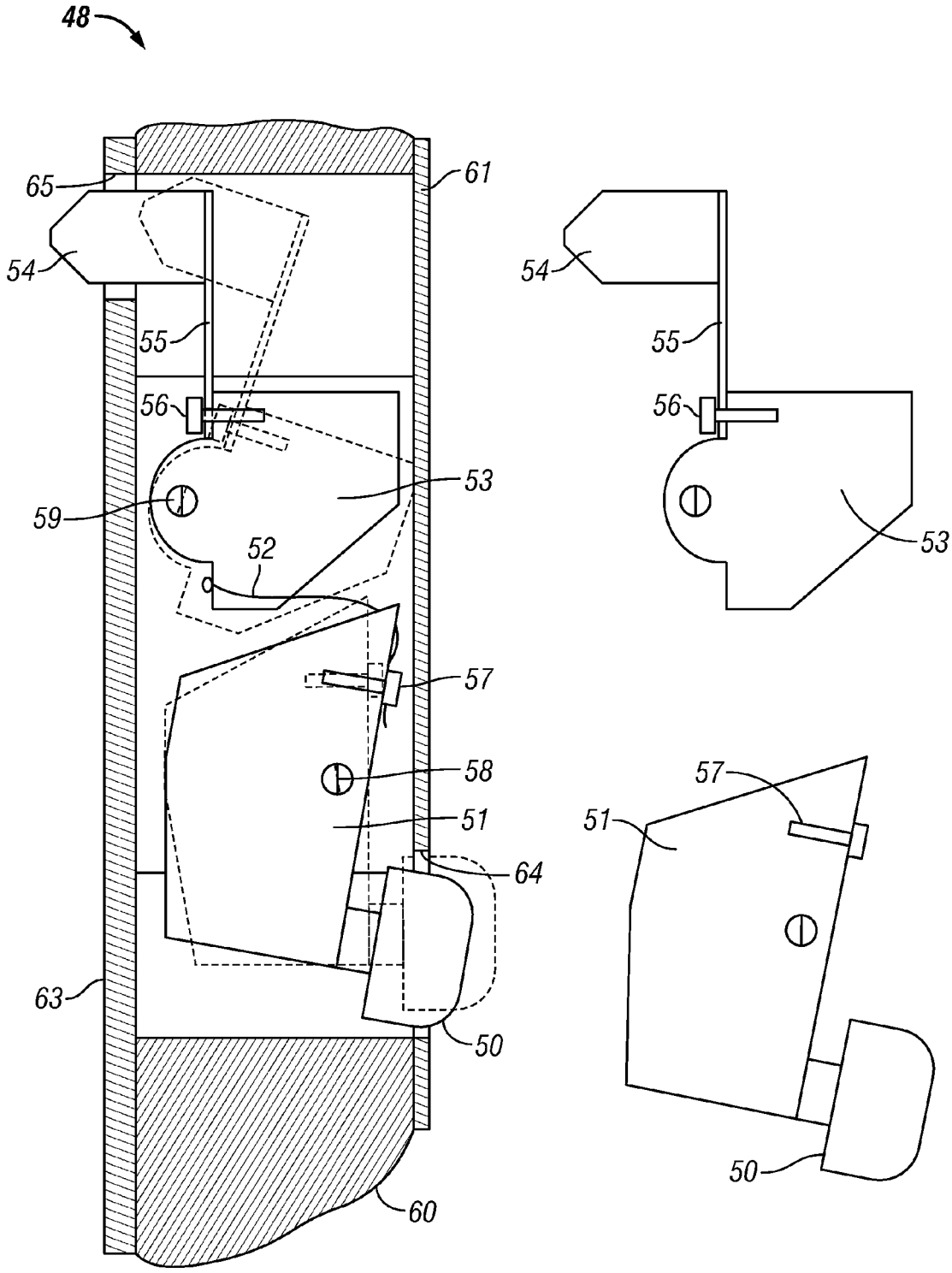
FIG. 5B is a side view, partially in section and partially blown up, of the striker assembly of FIG. 5A.
Figure 5C:
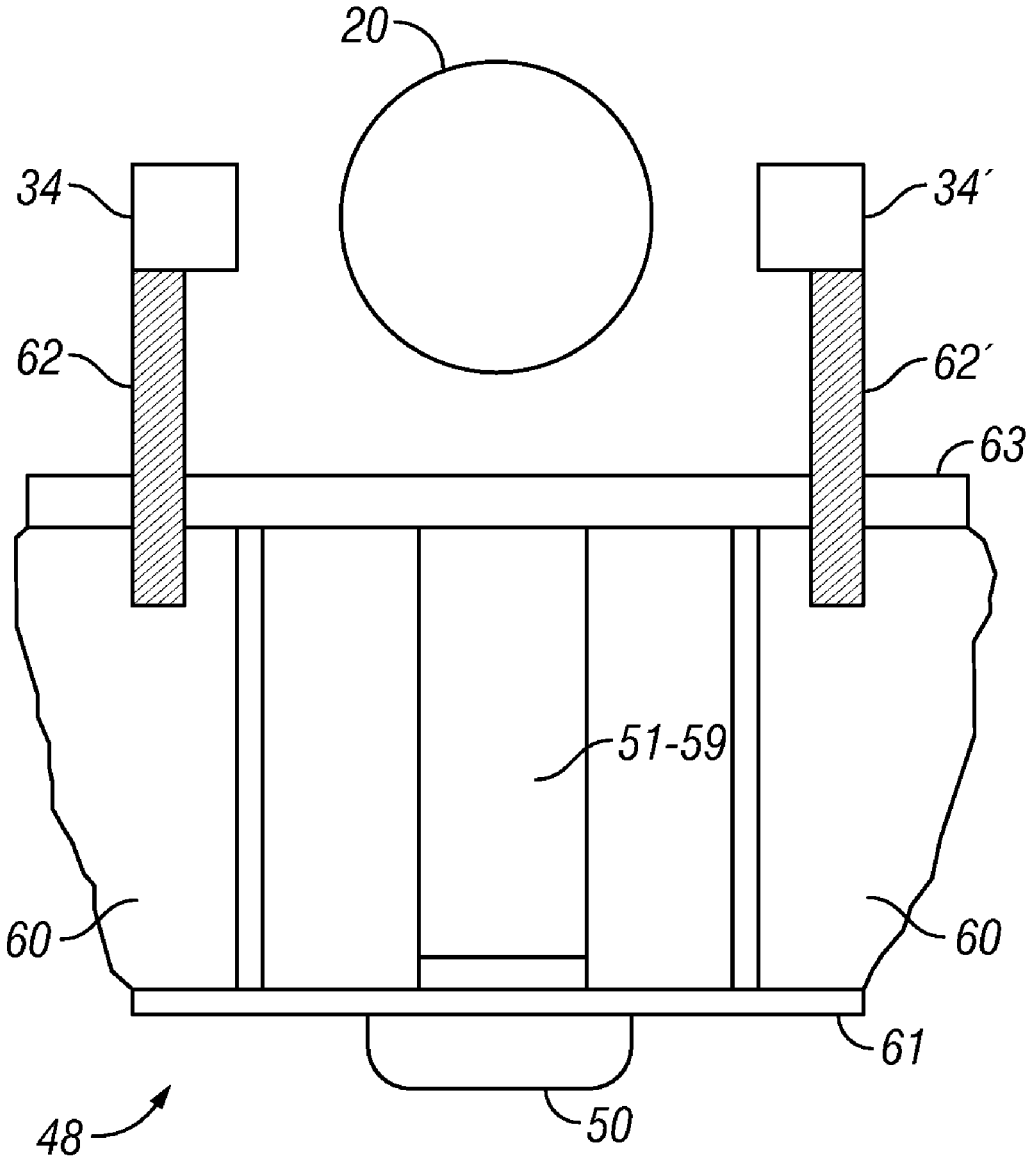
FIG. 5C is top schematic view of the striker assembly of FIGS. 5A-5B.

Referring to FIGS. 5A-5C, one embodiment of a striker assembly 48 is shown. The striker assembly housing 60, which can be wooden or metal, surrounds the internal striker assembly (collectively 51-59). Although the housing 60 is shown with an ovate cross-section, it can be square or any other polygonal shape. The front of the housing 60 has a first plate 61, which is preferably steel, mounted thereto and the rear of the housing 60 has a second plate 63, which is preferably steel, mounted thereto. The front plate 61 and back plate 63 can aid in protecting the striker mechanism from the elements and/or vandalism. The design of the housing 60 and/or front and back plates 61, 63 can be any type known in the art and are not limited to the design shown.

The striker assembly 48 mounts to an acoustical sculpture 10, as more clearly shown in FIG. 1, for example, by bolting, screwing, gluing, and/or welding the housing 60 to the tube frame of the main frame structure 12. In the embodiment shown, the housing 60 is connected, for example, by bolt, screw, adhesive and/or welding, to housing mounting studs (62, 62') which attach, for example, by bolt, screw, adhesive, and/or welding, to the stiles (34, 34') of the tube frame. A plurality of pairs of mounting studs (62, 62') can be used to provide the desired support of the striker assembly 48. The housing mounting studs (62, 62') can also be attached, for example, by welding, to the preferably steel housing back plate 63, shown more readily in FIG. 5C. The internal striker assembly (collectively 51-59 in FIG. 5B) of each main striker assembly 48 is activated by way of an actuator button 50, which can be accessible through an aperture 64 in the housing front plate 61, if so equipped.

Turning now to FIGS. 5B-5C, once the actuator button 50 is depressed by a user (the depressed or activated position is shown by dotted-lines), the internal striker assembly (collectively 51-59) functions to impact the chime tube 20, resulting in percussion and vibration of the chime tube 20. Depressing the actuator button 50 displaces the attached lower axle block 51, which can be weighted more heavily at the bottom portion and/or constructed of high-density polyethylene (HDPE), about a first transverse axle 58 in the housing 60. The transverse axle 58 can be created by a ¼" stainless steel rod, for example. A tether 52, for example, a 120-pound tensile stress stainless steel cable, can be connected to the upper anterior surface of the lower axle block 51 by a screw 57, preferably stainless steel, e.g., by frictionally retaining the tether 52 between the surface of the lower axle block 51 and the head of the screw 57. The use of a screw 52 is optional, but can allow the length of tether 52 between the two blocks (51, 53) to be adjusted.

The displacement of the lower axle block 51, by depressing the actuator button 50, results in the movement of the upper posterior surface of an upper axle block 53 towards the chime tube 20, as the lower posterior surface of the upper axle block 53 is attached to the tether 52 and can rotate about a second transverse axle 59, which can be created by a ¼" stainless steel rod. A leaf spring arm 55 with a hammer head 54, for example, having an HDPE striking surface, is affixed to the upper posterior surface of the upper axle block 53, for example, with a stainless steel screw 56. The upper axle block 53 can be formed of HDPE or be eccentrically weighted to increase the striking force of the hammer head 54 and/or to return the upper axle block to the at-rest position shown as a dotted line, when the actuator button 50 is not depressed.

The rotation of the lower axle block 51 displaces upper axle block 53 through the interconnected tether 52 which causes the affixed HDPE hammer head 54 to be disposed into contact with the chime tube 20, to produce sound. The term leaf spring, as used herein, is not limited to several layers of flexible metallic strips joined to act as a single unit, and a single piece of resilient material can be used without departing from the spirit of the invention. A non-resilient material can be used to create a hammer arm 55, however a resilient material can aid in preventing damage to the chime tube 20 by the hammer head 54. The embodiment of a striker assembly 48 in FIGS. 5A-5C can be used when the internal diameter of a chime tube 20 is such that sufficient momentum of the hammer head 54 cannot be generated, for example. By adding concentrated weight to either or both of the axle blocks (51, 53), axle blocks (51, 53) and striker button 50 can return to their respective non-depressed positions, as shown with dotted lines, without the use of a return spring due to the positioning of the weight and/or the axles (58, 59). A return spring can be used if so desired. The axle blocks (51, 53) can be the shape illustrated, or any shape known in the art. A resilient member can be added to the interior of the housing 60, front plate 61, and/or back plate 63 to prevent impact damage to or by the hammer 54 and/or axle blocks (51, 53).

Figure 6A:
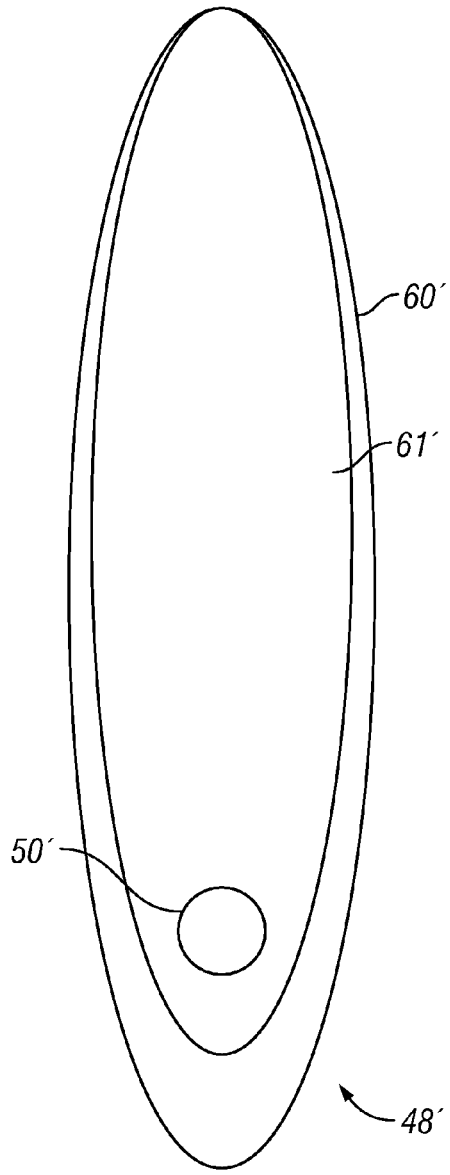
FIG. 6A is a front view of a second embodiment of a striker assembly of the acoustic sculpture of FIGS. 1-4.
Figure 6B:
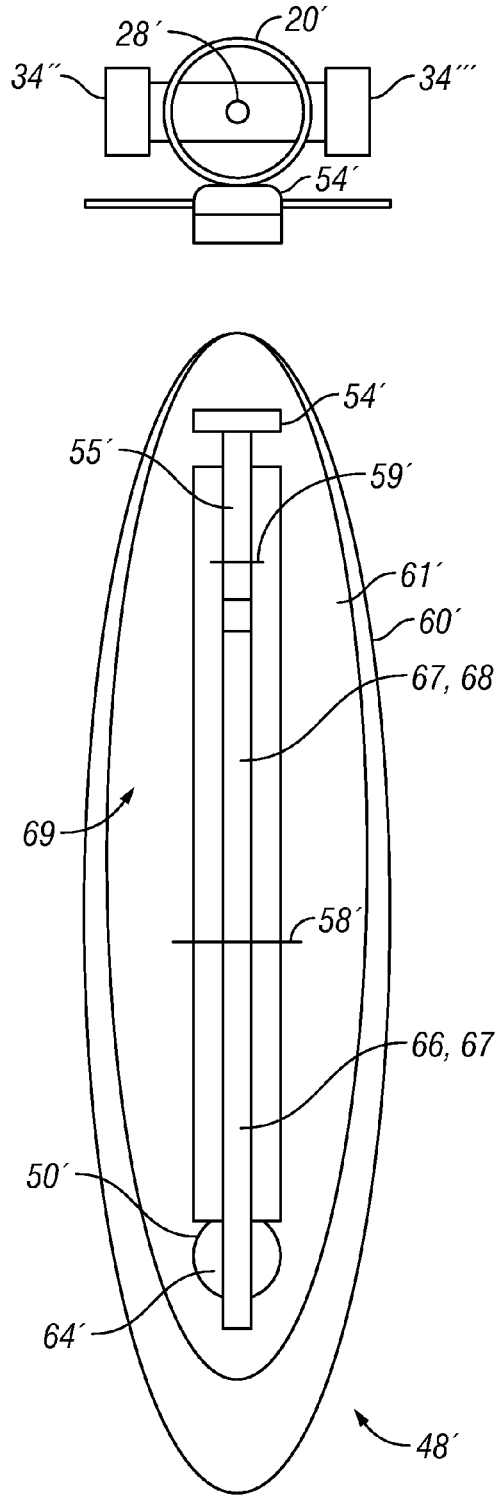
FIG. 6B is a rear and cross-sectional schematic view of the striker assembly of FIG. 6A.
Figure 6C:
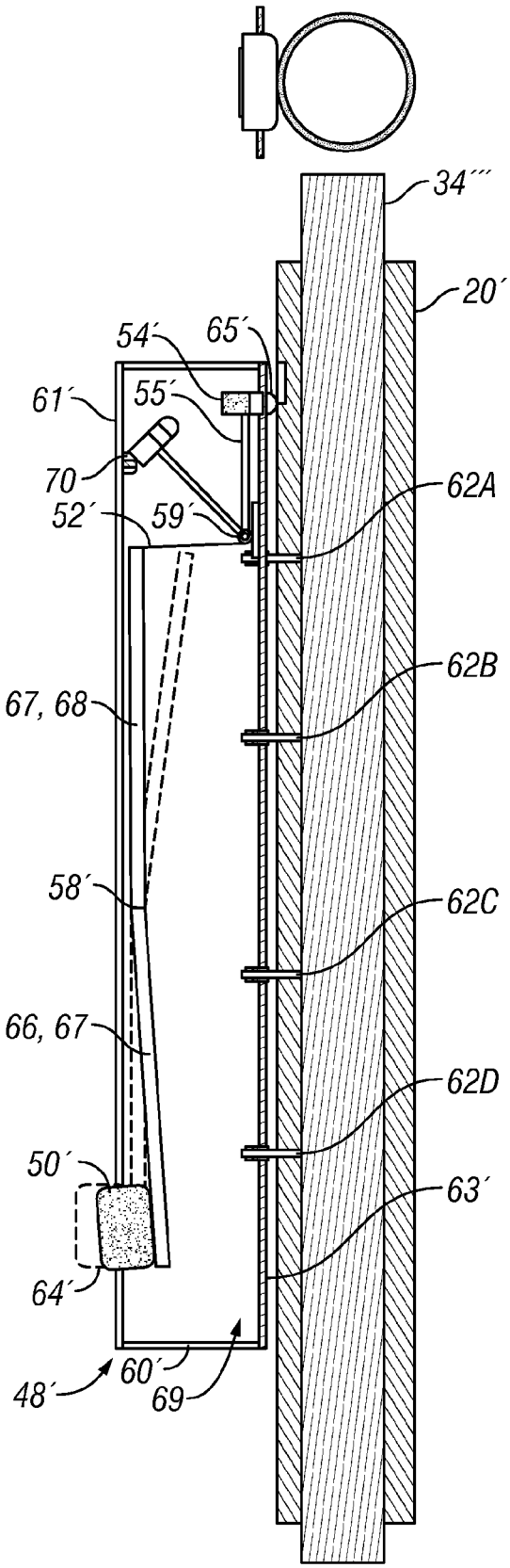
FIG. 6C is a side schematic view of the striker assembly of FIGS. 6A-6B mounted adjacent a chime tube.

FIGS. 6A-6C illustrate a second embodiment of a striker assembly 48', which can be used, for example, with a larger inner diameter tube providing a longer throw of a hammer head to generate the required momentum to produced a desired level of sound. Both types of striker assemblies (48 of FIGS. 5A-5C; 48' of FIGS. 6A-6C) can be used on the same acoustical sculpture 10, as shown in FIG. 1.

FIG. 6A is a front perspective view of a striker assembly 48' which includes a striker button 50', a housing 60' and a front plate 61'. FIG. 6B illustrates the rear view of the internal striker assembly 69, with the housing back plate 63' detached. Front plate 61' or back plate 63' can attach to the housing 60' by any means known in the art, for example, by adhesive on overlapping adjacent sections.

The striker assembly 48' mounts to an acoustical sculpture 10, as more clearly shown in FIGS. 1 and 6C, for example, by bolting, screwing, gluing, and/or welding the housing 60' to the tube frame of the main frame structure 12. In the embodiment shown, the housing 60' is connected, for example, by bolt, screw, adhesive and/or welding, to housing mounting studs (62A-62D) which attach, for example, by bolt, screw, adhesive, and/or welding, to the stiles (34", 34'") of the tube frame. Any number of mounting studs (62A-62D) can be used to provide the desired support of the striker assembly 48'. The housing mounting studs (62A-62D) can also be attached, for example, by welding, to the preferably steel housing back plate 63', shown more readily in FIG. 6C. The internal striker assembly 69 of each main striker assembly 48' is activated by way of an actuator button 50', which can be accessible through an aperture 64' in the housing front plate 61', if so equipped.

The internal striker assembly 69 is activated by depressing the actuator button 50'. Once the actuator button 50' is depressed by a user (the depressed or activated position is shown by solid lines), the internal striker assembly 69 functions to impact the chime tube 20' through a hammer head 54' extending through the second aperture 65', resulting in sound.

When depressed, the actuator button 50' displaces a lever 67 which pivots about a first transverse axle 58' mounted in the housing 60'. An upper section 68 of the lever 67 is mounted to the lower section of the lever 66 to form an acute angle between the respective longitudinal axes. As the actuator button 50' is attached to the lower section 66 of the lever 67, disposing the actuator button 50', and thus the attached lever 67, distally causes the upper section 68 of the lever 67 to be disposed proximal to the user. The proximal movement of the upper section 68 of the lever 67 causes an attached tether 52', which can be a 120-pound tensile stress stainless steel cable, to similarly be disposed toward the user. The other end of the tether 52' can be mounted to the posterior side of a lower section of a hammer arm 55', which can be a leaf spring arm as disclosed above.

As the hammer arm 55' pivots around a second transverse axle 59' mounted in the housing 60', the second transverse axle 59' acts as a fulcrum to pivot the hammer head 54' about the axle 59', in a movement akin to activating a bass drum pedal. Further, a separate curved member (not shown), for example, a cam or a sprocket (with chain portion of the tether 52'), can be used to translate the substantially linear motion of the upper section 68 of the lever 67 into rotational movement of the hammer head 54' about the second transverse axle 59'. FIG. 6C further illustrates the un-depressed, or non-activated at-rest position of the striker assembly 48', as shown by dotted lines. Due to the vertical mounting of the chime tube 20' and/or placing a concentrated mass on the proximal portion of the hammer head 54', after the hammer head 54' impacts the chime tube 20', gravity, or an optional return spring, can return the hammer head to an optional rest 70 mounted to the housing 60, shown here attached to the housing front plate 61'. The striker assemblies (48, 48') of FIGS. 5A-5C and FIGS. 6A-6C are both shown installed in FIG. 1.

Figure 7:
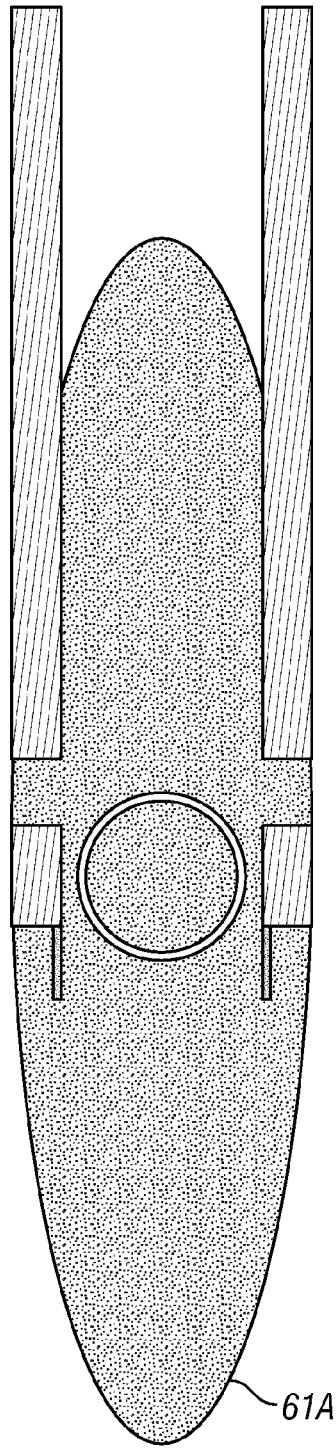
FIG. 7 is an alternative striker housing front plate, according to one embodiment of the invention.

FIG. 7 illustrates an optional housing front plate 61A of a striker assembly, wherein the aperture for an actuator button is in a different location.

Any of the axles (58, 59, 58', 59') can be mounted to the front (61, 61') or back (63, 63') plate without departing from the spirit of the invention.

While the invention has been described with respect to a limited number of embodiments, those skilled in the art will appreciate numerous modifications and variations therefrom. It is intended that the appended claims cover all such modifications and variations as fall within the true spirit and scope of the invention.

The invention claimed is:

1. An acoustic sculpture comprising:

a main frame structure including an upper support member and a lower support member; and a plurality of tube assemblies of varied mass, each tube assembly including:

a vertical chime tube acoustically suspended from a coaxial mounting rod, a tube frame supporting the coaxial mounting rod and mounted to the frame structure at the upper and lower support members, and a striker assembly mounted on the tube frame and including a housing, and an actuator button accessible through a first aperture in the housing and operatively connected to transmit motion to a hammer having a head to strike the vertical chime tube through a second aperture in the housing.

2. The acoustic sculpture of claim 1 wherein the upper and lower support members diverge from a first end where the members are seemed together to an opposite end where the members are spaced apart and connected to an upright support post.

3. The acoustic sculpture of claim 1 wherein the tube frame comprises a pair of spaced stiles that span between the upper and lower support members of the main frame, and a pair of opposing transverse straps that span between the pair of spaced stiles at an upper and a lower ends thereof.

4. The acoustic sculpture of claim 1 wherein the plurality of tube assemblies further comprises a cable extending through a first transverse bore in the coaxial mounting rod and a first end of the cable attached to a first section of the vertical chime tube and a second end of the cable attached to an opposing second section of the vertical chime tube to acoustically suspend the vertical chime tube from the coaxial mounting rod.

5. The acoustic sculpture of claim 4 wherein the plurality of tube assemblies further comprises a second cable extending through a second transverse bore in the coaxial mounting rod and a first end of the second cable attached to a third section of the vertical chime tube and a second end of the second cable attached to an opposing fourth section of the vertical chime tube to acoustically suspend the vertical chime tube from the coaxial mounting rod, wherein the second transverse bore is offset from the first transverse bore.

6. The acoustic sculpture of claim 5 wherein the first, second, third and fourth sections are each a node of the vertical chime tube.

7. The acoustic sculpture of claim 1 wherein the striker assembly comprises:

a lower bottom-weighted axle block pivotable about a first transverse axle of the housing having the actuator button mounted thereon and accessible through the first aperture in the housing; and an upper eccentrically-weighted axle block pivotable about a second transverse axle of the housing and connected by a tether to the lower axle block, a first end of a leaf spring arm attached to the upper eccentrically-weighted axle block and a second end of the leaf spring arm attached the hammer head, the hammer head striking the chime tube when the actuator button is displaced.

8. The acoustic sculpture of claim 1 wherein the striker assembly comprises:

a lever pivotable about a first transverse axle of the housing, the actuator button disposed on a first end of the lever and an opposing second end of the lever connected by a tether to a first end of an arm of the hammer, the arm having the hammer head on an opposing second end and the first end of the arm pivotable about a second transverse axle in the housing, the hammer head striking the chime tube when the actuator button is displaced.

9. The acoustic sculpture of claim 8 wherein the first end of the arm further comprises a curved member with the tether connected to a distal portion thereof to permit the hammer head to pivot towards the second aperture when force is applied to the tether by the lever.

10. The acoustic sculpture of claim 8 wherein the lever further comprises a first section and a second section, each extending from the first transverse axle and forming an acute angle therebetween.

* * * * *

UNITED STATES PATENT AND TRADEMARK OFFICE

CERTIFICATE OF CORRECTION

PATENT NO. : 7,534,949 B1
APPLICATION NO. : 11/752892
DATED : May 19, 2009
INVENTOR(S) : James Alan Estes It is certified that error appears in the above-identified patent and that said Letters Patent is hereby corrected as shown below:

Column 7, line 29, in claim 2, “seemed” should read -- joined --.

Signed and Sealed this

Seventh Day of July, 2009

JOHN DOLL
*Acting Director of the United States Patent and Trademark Office*